US010609764B2

(12) United States Patent
Reiter et al.

(10) Patent No.: US 10,609,764 B2
(45) Date of Patent: Mar. 31, 2020

(54) TEMPERATURE CONTROLLER

(71) Applicants: Werner Reiter, Klosterneuburg (AT); Josef Reithofer, Wolfpassing (AT); Peter Klaus Soukup, Gramatneusiedl (AT)

(72) Inventors: Werner Reiter, Klosterneuburg (AT); Josef Reithofer, Wolfpassing (AT); Peter Klaus Soukup, Gramatneusiedl (AT)

( * ) Notice: Subject to any disclaimer, the term of this patent is extended or adjusted under 35 U.S.C. 154(b) by 622 days.

(21) Appl. No.: 15/028,506

(22) PCT Filed: Oct. 8, 2014

(86) PCT No.: PCT/EP2014/071553

§ 371 (c)(1),
(2) Date: Apr. 11, 2016

(87) PCT Pub. No.: WO2015/052241

PCT Pub. Date: Apr. 16, 2015

(65) Prior Publication Data

US 2016/0255678 A1 Sep. 1, 2016

(30) Foreign Application Priority Data

Oct. 10, 2013 (DE) ..... 10 2013 111 202

(51) Int. Cl.
*H05B 1/02* (2006.01)
*H01H 37/48* (2006.01)
(Continued)

(52) U.S. Cl.
CPC ..... *H05B 1/0202* (2013.01); *H01H 37/22* (2013.01); *H01H 37/48* (2013.01); *H05B 1/0258* (2013.01); *H05B 3/24* (2013.01)

(58) Field of Classification Search
CPC ..... H01H 37/22; H01H 37/24; H01H 37/26; H01H 37/28; H01H 37/30; H01H 37/32;
(Continued)

(56) References Cited

U.S. PATENT DOCUMENTS 7,345,572 B2 * 3/2008 Losbichler ..... H01H 37/48 337/393
2011/0043322 A1 * 2/2011 Castillo ..... H01H 37/22 337/394

FOREIGN PATENT DOCUMENTS

CN 101996819 3/2011
EP 0394693 A2 * 10/1990 ..... H01H 37/48

OTHER PUBLICATIONS

German to English machine translation of EP 0394693, Published in 1990.*

(Continued)

*Primary Examiner* — Michael G Hoang
(74) *Attorney, Agent, or Firm* — K. David Crockett, Esq.; Crockett & Crockett, PC

(57) ABSTRACT

A temperature controller including a housing, a temperature sensor with an expansion element which generates a movement stroke as a function of the temperature. The controller includes a switching system having a switching spring on a switching spring base, upon which there acts the expansion element. An end remote from the spring contact of the switching spring is fastened to the switching spring base, an end remote from the fastening of the switching spring of the switching spring base is held securely and immovably on the temperature controller housing, the switching spring base working together with an adjustment element. To adjust the switching point of the switching system, the switching spring base together with the switching spring can be moved relative to the expansion element and/or to the actuating element.

17 Claims, 3 Drawing Sheets

(51) Int. Cl.
*H01H 37/22* (2006.01)
*H05B 3/24* (2006.01)

(58) Field of Classification Search
CPC .... H01H 37/48; H05B 1/0202; H05B 1/0258; H05B 3/24
USPC ..... 219/448.11, 448.17, 448.19; 337/392–394, 396–398
See application file for complete search history.

(56) References Cited

OTHER PUBLICATIONS

Chinese Office Action dated Jan. 19, 2017 from Chinese patent application No. 201480055510.7.

* cited by examiner

TEMPERATURE CONTROLLER

TECHNICAL FIELD

The invention relates to a temperature controller and a method for adjusting the switching point of a switching system of such a temperature controller.

BACKGROUND OF THE INVENTION

Temperature controllers for electric heating elements of hobs are known in various embodiments and are used, inter alia, for electric hobs and specifically for glass ceramic hobs, namely for controlling or regulating the electric heating element of a hob. Specifically in the case of these applications, the temperature controllers usually comprise two electric switching systems having different switching temperatures, i.e., switching points. In this context, one switching system serves as overload or overtemperature protection for the electrical heating element and has a switching point between approximately 500° C. to 600° C. The second switching system serves for controlling a residual heat warning indicator and has a switching point at approximately 50° C. to 80° C., i.e., upon reaching this switching point, this further switching system effects the activation of the residual heat warning indicator. Each switching system comprises, inter alia, a switching spring base and at least one switching spring, the switching spring being fastened with one end to the switching spring base and having a spring contact that interacts with a stationary contact.

It is also known to adjust the switching point, in particular of the second switching system, by moving its switching spring base, namely by setting and adjustment elements (GB 2 175 141 A) formed by adjusting or grub screws, or in that the switching spring base, which is fixed at one end, i.e., immovably fastened in a temperature controller housing, is moved by bending (EP 2 287 877 A1). In the latter case, the selected setting of the switching spring base has to be fixed after the adjustment in a further method step, namely by welding a locking arm formed on the switching spring base to a holding arm of the temperature controller housing.

The known temperature controllers require a relatively complicated method for adjusting since rotating movements and adjusting tools or additional locking by welding a locking arm in place are required.

SUMMARY OF THE INVENTION

It is an object of the invention to provide a temperature controller which, while exhibiting a simplified design structure, enables simplified adjustment with high precision. This object is achieved according to the invention by the temperature controller according to independent claim 1 and the method for adjusting the switching point of a switching system of a temperature controller according to independent claim 9. Further advantageous aspects, details and configurations of the invention arise from the dependent claims, the description and the drawings.

The present invention provides a temperature controller, particularly for electric heating elements of hobs. The temperature controller comprises a temperature controller housing, a temperature sensor with an expansion element which generates a movement stroke in a direction of action AT as a function of the temperature, at least one switching system having a switching spring at a switching spring base, on which the expansion element or an actuating element moved by the expansion element acts in order to switch the switching system, wherein the switching spring, with an end remote from its spring contact, is fastened to the switching spring base, wherein the switching spring base, at an end remote from the fastening of its switching spring, is held securely and immovably on the temperature controller housing and interacts with an adjustment element, one section or end of which is held on a region of the temperature controller housing and another section or end of which rests against the switching spring base, and by means of which, in order to adjust the switching point of the switching systems, the switching spring base together with the switching spring can be moved relative to the expansion element and/or to the actuating element upon change of the distance between the region of the temperature controller housing and the switching spring base. The adjustment element is an elongate element having a longitudinal direction A, wherein the adjustment element, for adjustment in an adjustment direction J, can be deformed permanently transverse to its longitudinal direction A, upon change of the distance between the sections or ends.

The advantages of a temperature controller according to the invention are, inter alia, that after completion of the adjustment, no further step for fixing the switching spring base is required, that adjusting by means of an adjusting plunger can be carried out solely by a translational movement, namely with high accuracy, that a relatively wide adjusting range can be achieved during the adjustment or by resetting the curved region, that the necessary temperature offset of the switching point of the switching system can be taken into account via a corresponding offset path or additional stroke of the adjusting plunger, and that the position and orientation of the adjustment element within the temperature controller can be selected such that the adjusting plunger can act on the adjustment element without any problems through an open side of the temperature controller housing.

The high accuracy achievable with the adjustment element is in particular based on the fact that by deforming the adjustment element by the adjusting plunger, a kind of a "transmission ratio" is created. The travel distance of the translational movement of the adjusting plunger, as result of which a permanent deformation of the adjustment element is achieved upon changing the distance between the sections or ends of the adjustment element, is significantly larger than the adjusting distance at the spring mounting. Thus, the accuracy of the adjustment is higher in accordance with the transmission ratio.

Adjusting through permanent deformation of the adjustment element thus can be carried out in a simple manner by linear or translational movements, namely by using devices or positioning systems by means of which the translational movement during the adjustment is monitored and/or controlled with high accuracy. An additional fixing of the respective taken adjustment is not required.

According to a preferred embodiment, the switching spring base is provided with a predetermined bending point in the form of a tapering. Tapering of the switching spring base is to be understood as an expansion of the switching spring base that is reduced in the direction of action (AT) and preferably substantially has the shape of a groove. The predetermined bending point is provided in a region of the switching spring base that is adjacent to the end of the switching spring base at which the switching spring base is securely and immovably held on the temperature controller housing. During the adjusting process, the switching spring base bends at this predetermined bending point. Since the predetermined bending point is outside of the spring tension range, the spring force of the switching spring is not changed or only insignificantly changed by the adjustment. The region of the switching spring base which is adjacent to the end of the switching spring base at which the switching spring base is securely and immovably held on the temperature controller housing is to be understood as half of, preferably a third of the entire expansion of the switching spring base transverse to the direction of action (AT).

Basically, the adjustment element can be configured to be permanently deformable upon decreasing or increasing the distance between its sections or ends. However, preferred are embodiments in which the adjustment element is configured to be deformed permanently upon increasing the distance between its sections or ends.

Particularly preferred, the adjustment element is provided between its sections or ends with a curved region which, for the adjustment, is deformable by changing the distance between the sections or ends. This curved region of the adjustment element is then configured to be permanently deformable upon increasing the distance between the sections or ends.

The curved region of the adjustment element preferably has a U- or V-shape, wherein the angle enclosed by the legs of the V can be substantially arbitrary, thus has only to meet the requirements to be smaller than 180° and greater than 0°. The legs of the V preferably enclose an angle between 45° and 135°, particularly preferred an angle between 60° and 120°. In particular the U- or V-shape of the curved section leads to a reproducible relationship between the deflection or the extent of the stroke of the adjusting plunger and the resulting change or increase of the distance between the ends and thus the deflection of the switching spring base.

In a preferred embodiment, the temperature controller has at least two switching systems which are controlled by the temperature sensor and each of which has a switching spring at a switching spring base. The adjustment element acts on the switching spring base of a second one of the two switching systems. In this case, for example, the switching system which has the lower switching point and, for example, serves for controlling the residual heat warning indicator, is adjusted by moving its switching spring base by means of the adjustment element.

Preferably, the at least two switching systems are arranged successively in the direction of action of the expansion element in the temperature controller housing. In this arrangement, the expansion element acts particularly effectively on the switching springs of the switching systems.

According to another preferred embodiment of the present invention, one end of the adjustment element rests against a switching spring base side that faces away from the switching spring.

The adjustment element is preferably composed of a metallic material. In production, metallic material can easily be formed in a manner as desired for the elongated adjustment element. When force is applied to the elongated adjustment element and if a metallic material is used, the adjustment element is deformed permanently in the desired manner.

The present invention also comprises a method for adjusting the switching point of a switching system of an above-described temperature controller. The method comprises the steps of a) providing an above-described temperature controller,
b) fixing the temperature controller in an adjusting device,
c) moving the adjusting plunger towards the adjustment element,
d) performing an electric contact test using the connectors of the switching systems,
e) saving the position of the adjusting plunger as soon as the electrical contact test indicates a negative signal,
f) moving the adjusting plunger in a direction away from the adjustment element,
g) performing an electrical contact test using the connectors of the switching system.

Thus, for adjusting the switching point of the switching system, the temperature controller housing of the temperature controller is clamped in an adjusting device. By moving the adjusting plunger towards the adjustment element, contact with the curved region of the adjustment element is established by increasing the distance between the ends of the adjustment element. By advancing the adjusting plunger, the adjustment element then is deformed in such a manner that the switching system opens, thus, the spring contact lifts off from the contact. This can be detected by an electrical contact test or with an electrical measuring circuit connected to the connectors of the respective switching system. As soon as the switching system opens, thus, the electrical contact test indicates a negative signal, the current position of the adjusting plunger is saved. Then, the adjusting plunger is moved back, thus away from the adjustment element, and an electrical contact test is performed again, thereby checking whether the switching system remains open.

Preferably, after step g), the following steps are carried out:

h) moving the adjusting plunger towards the adjustment element when the electrical contact test performed in step g) indicates a positive signal,
i) performing an electrical contact test using the connectors of the switching system,
j) saving the position of the adjusting plunger as soon as the electrical contact test performed in step i) indicates a negative signal,
k) moving the adjusting plunger in a direction away from the adjustment element,
l) performing an electrical contact test using the connectors of the switching system.

In step f) of the method according to the invention, the adjusting plunger is moved away again from the adjustment element. Since there is always an elastic component when reversing the curvature of the curved region of the adjustment element, this back movement of the adjusting plunger normally results in closing the switching system again. The electrical contact test performed in step g) then indicates a positive signal. If this should be the case, the adjusting plunger is moved in a further adjusting step towards the adjustment element. During this further advancing of the adjusting plunger, the position of the adjusting plunger reached and saved in the preceding adjusting step is exceeded by a small stroke or amount (offset).

Thereafter, the electrical contact test as well as saving the position of the adjusting plunger as soon as the electrical contact test indicates a negative signal is carried out again. Subsequently, the adjusting plunger is moved away from the adjustment element again and it is checked through a further electrical contact test whether the switching system remains open after the back movement of the adjusting plunger.

After carrying out step l), the steps h) to l) are preferably repeated several times until the electrical contact test performed in step l) indicates a negative signal. Thus, if necessary, the forward and backward movement of the adjusting plunger including the electrical contact test can be repeated multiple times until the switching system remains open and therefore a sufficient non-elastic or permanent deformation of the adjustment element is achieved.

For this reason, the switching system would open at a temperature that corresponds to that temperature that is detected by the temperature sensor during the adjustment. If this is, for example, the normal ambient temperature and opening the switching system is already desired at a switching point above the normal ambient temperature, for example at the switching point between 50° and 80° C., the adjustment then is carried out in such a manner that the adjustment element is deformed in a first step only to such an extent that the switching system actually first opens, but closes again after the adjusting plunger is moved back. Proceeding from the saved position of the adjusting plunger at the end of the first adjusting step, another movement of the adjusting plunger with a small stroke or amount (offset) takes place again. The latter is set in such a manner that this movement is not enough to keep the switching system open after the adjusting plunger is moved back, but that it moves the end only to such an extent that the desired switching point above the ambient temperature is reached.

According to a preferred embodiment, an adjusting platelet is arranged between the actuating element and the switching spring prior to step c) of the method according to the invention. This adjustment platelet assumes the function of a spacer, wherein the thickness of the platelet corresponds to the temperature difference (temperature offset) between the ambient temperature during the adjustment and the temperature of the desired switching point.

The adjusting platelet arranged between the actuating element and the switching spring is preferably removed as soon as the electrical contact test using the connectors of the switching system indicates a negative signal. The adjustment thus is carried out in at least one or preferably in at least two steps in such a manner that the switching system remains open after the adjustment and after retracting the adjusting plunger. Then, the adjusting platelet is removed. For setting the temperature offset as precisely as possible, the ambient temperature can also be taken into account during the adjustment and can be compensated accordingly.

BRIEF DESCRIPTION OF THE DRAWINGS

The invention is explained below in greater detail by means of exemplary embodiments in connection with the drawings. In the figures.

WAYS OF CARRYING OUT THE INVENTION

Figure 1:
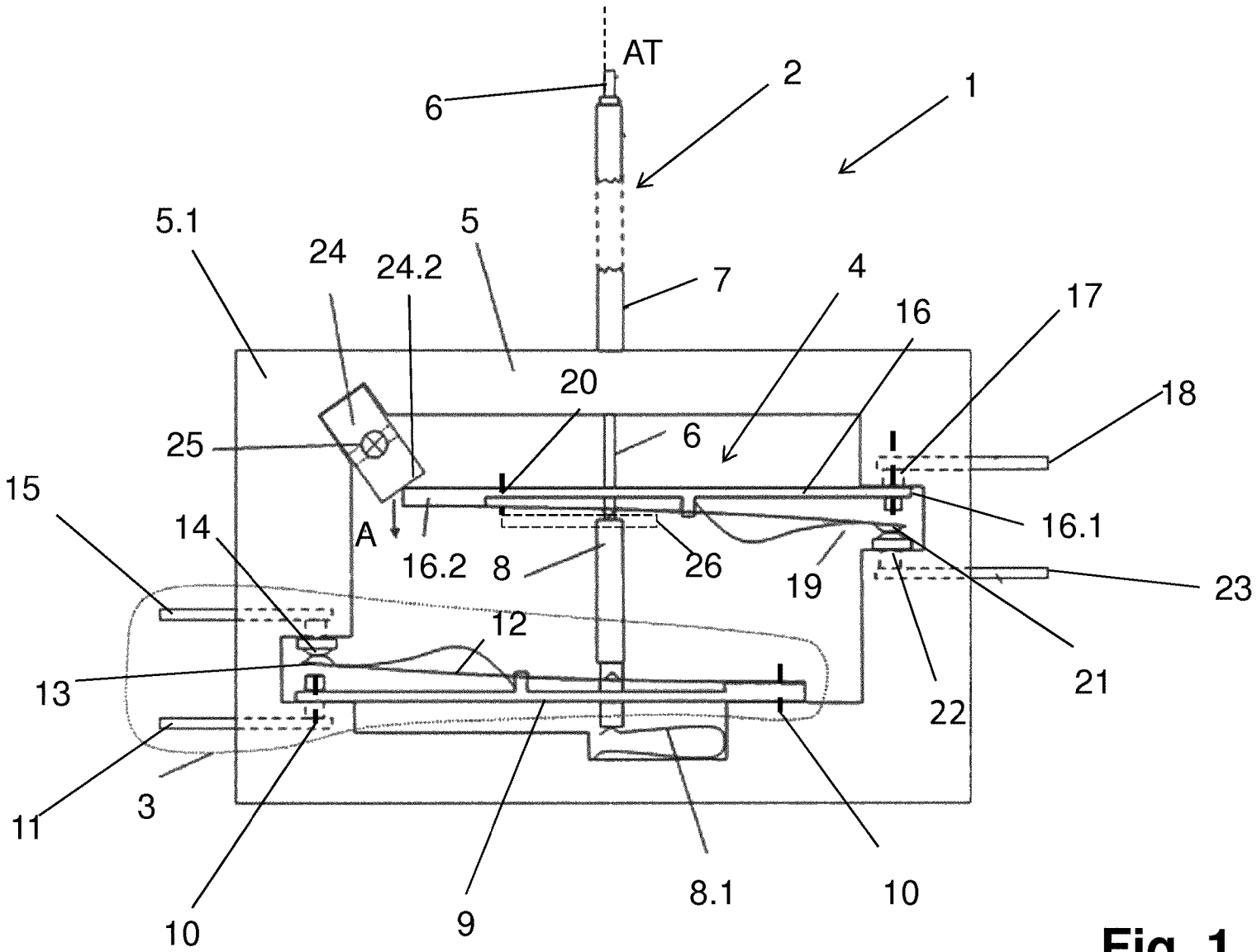
FIG. 1 shows in a schematic illustration and a side view a temperature controller according to the invention.

The temperature controller generally designated by 1 in FIG. 1 is intended, for example, for use in an electric hob, e.g. in an electric glass ceramic hob and, for this purpose, comprises two electric switching systems 3 and 4 which are controlled or actuated in a temperature-independent manner via a rod-shaped temperature sensor 2. A first switching system 3 thereof, which serves, for example, as protection against overheating of the hob or the respective electric heating element, has a switching point, e.g., in the range between 500° C. and 600° C. Upon reaching this switching point, the switching system 3 interrupts the electric current flow to the heating element. The second switching system 4 serves, for example, for controlling or switching a residual heat warning indicator of the hob and has a switching point, e.g., between 50° C. and 80° C. The second switching system 4 opens only at a temperature that lies below this switching point.

The temperature controller 1 comprises a temperature controller housing 5 which is made from an electrically insulating material, e.g., ceramic, at least in such sections in which electrical insulation is required. The rod-shaped temperature sensor 2 projects beyond the outside of the temperature controller housing 5. The temperature sensor 2 is formed in a known manner from a rod-shaped expansion element 6 and a tube section 7, wherein the tube section 7 encloses the rod-shaped expansion element 6 in such a manner that a relative movement of the expansion element 6 within the tube section 7 is possible. At one end, the tube section 7 is fixed on the temperature controller housing 5.

At the temperature sensor's 2 other end located remote from the temperature controller housing 5, the expansion element 6 and the tube section 7 are connected to one another. The rod-shaped expansion element 6 extends into the interior of the temperature controller housing 5 and interacts there with the switching systems 3 and 4, namely via an actuating element 8 attached onto the free lower end of the expansion element 6. The materials used for the expansion element 6 and the tube section 7 are selected such that the thermal expansion coefficient of the rod-shaped expansion element 6 is significantly greater than the thermal expansion coefficient of the tube section 7.

The switching system 3 is substantially composed of a switching spring base 9 formed as an elongated tongue and made from a metallic material and which, with its longitudinal extent being oriented transverse or perpendicular to an axis AT of the rod-shaped temperature sensor 2, is fixed at its ends at 10 in the temperature controller housing 5. One end of the switching spring base 9 is connected to an electrical connector 11. The switching system 3 further comprises a switching spring 12 which is arranged at that side of the switching spring base 9 that faces towards the temperature sensor 2 and extends almost over the entire length of the switching spring base 9 and is fastened with one end to the switching spring base 9 near the end thereof.

The switching spring 12 has at its other end a switching or spring contact 13 which interacts with a stationary contact 14 which is provided on the temperature controller housing 5 and is connected to an electrical connector 15. The two electrical contacts 11 and 15 extending out of the temperature controller housing 5 form the connectors of the switching system 3 and, e.g., are integral part of an electrical circuit for supplying the heating element of the hob.

Furthermore, the arrangement is made such that the switching spring 12 is in the normal state, i.e., in its state not actuated by the temperature sensor and in its position closing the switching system 3, in which the spring contact 13 rests against the stationary contact 14, and the switching spring 12 opens the switching system 3 only upon reaching the temperature corresponding to the switching point by moving away or displacing the spring contact 13 from the contact 14. For this purpose, the actuating element 8 acts upon the switching spring 12 in the sense of this spring approaching the spring base 9.

The switching system 4 comprises a spring base 16 which, again, is made in a tongue-like or elongated manner from a metallic material with spring properties and, with its longitudinal extent, is oriented transverse or perpendicular to the axis AT. Only one end 16.1 of the spring base 16 is fixed at 17 on the temperature controller housing 5 and is connected there to a connector 18 that extends out of the temperature controller housing 5. Near the other end 16.2, which is located remote from the fastening 17, the one end of a second switching spring 19 is fastened at 20 on the spring base 16. The switching spring 19 is located at that side of the switching spring base 16 that faces away from the temperature sensor 2 and has at its free end a spring contact 21 which interacts with a fixed contact 22 which is provided on the temperature controller housing 5 and is connected to an electrical connector 23.

The two connectors 18 and 23 form the connectors of the switching system 4. The latter is configured such that after adjusting the temperature controller 1 of the switching system 4, it is open in the initial state, i.e., the switching spring 19 is deflected or moved towards its switching spring base 16 by the actuating element 8 to such an extent that the spring contact 21 is spaced apart from the stationary contact 22. The switching system 4 is closed, i.e., the spring contact 21 rests against the contact 22, only at a temperature at the temperature sensor 2 that corresponds to or exceeds the switching point of the switching system 4.

The rod-shaped expansion element 6 extends through the switching spring base 16 and the switching spring 19. The actuating element 8 attached onto the lower end of the expansion element 6 is located between the two switching springs 12 and 19. The latter are each composed of a material which is electrically conductive and suitable for switching springs and, in addition, are each designed for a snap-in movement or for quick opening and closing of the switching systems 3 and 4.

8.1 designates a spring which acts upon the lower end of the actuating element 8 shown in FIG. 1 and secures the actuating element 8 on the rod-shaped expansion element 6 by an axial force which acts upwards in the illustration of FIG. 1.

The characteristic of the temperature controller 1 is the biasing or adjustment element 24 for the switching spring base 16 which is made in a flap- or strap-like manner from a permanently deformable material, for example metal, and which is fixed with one section or end 24.1 on a region 5.1 of the temperature controller housing 5, for example by clamping, and acts with its other section or end 24.2 on that end of the switching spring 16 that is remote from the fastening 17 and therefore adjacent to the fastening 20.

Figure 2:
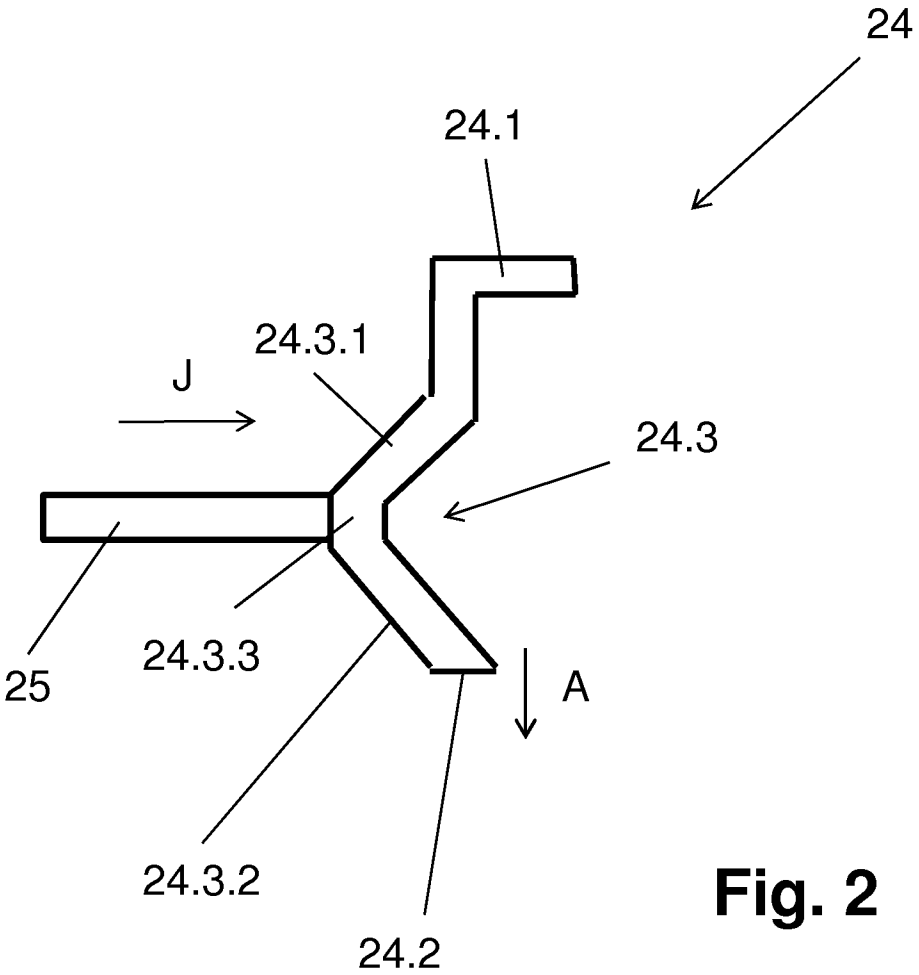
FIG. 2 shows in an individual illustration and in a side view a biasing or adjustment element of the temperature controller of FIG. 1.

In detail (see FIG. 2), the adjustment element 24 in the illustrated embodiment is configured such that it has a curved region 24.3 which is situated between its two ends 24.1 and 24. 2 and, in the illustrated embodiment, is configured to be angular or V-shaped, namely having two legs 24.3.1 and 24.3.2 enclosing an angle of at least 90°, preferably an angle greater than 90° between one another, and having a section 24.3.3 that connects these legs.

Due to a permanent deformation of the adjustment element 24 perpendicular to its surface sides at the region 24.3, a change of the distance between the ends 24.1 and 24.2 and therefore a displacement of the end 16.2 of the switching spring base 16 and an adjustment of the switching point of the switching system 4 in the ways as described in greater detail below is possible. In the embodiment illustrated, this adjustment is carried out upon partial reforming of the curvature of the region 24.3 by means of an adjusting plunger 25 acting on the convex side thereby increasing the distance between the ends 24.1 and 24.2, wherein the free end 16.2 of the switching spring base 16 is moved against the internal elasticity of said base in the direction of the arrow A, i.e. towards the actuating element 8. The adjustment element 24 rests with its end 24.2 only against the upper side of the switching spring base 16, which upper side faces towards the temperature sensor 2.

The adjustment of the switching point of the first switching system 3 is usually carried out by moving the rod-shaped expansion element 6 by a required setting or adjusting stroke corresponding to the desired switching point and by subsequently fixing the rod-shaped expansion element 6 at the tube section 7. After adjusting the switching point of the first switching system 3, the switching system 4, which is not adjusted yet, is also in a closed state although the temperature at the temperature sensor 2 lies below the switching point of the switching system 4.

In order to adjust the switching point of the switching system 4, the temperature controller 1 is clamped with its temperature controller housing 5 in an adjusting device, and the curved region 24.3 of the adjustment element 24 is deformed by means of the adjusting plunger 25 by advancing the adjusting plunger 25 and thereby increasing the distance between the ends 24.1 and 24.2 until the switching system 4 opens, i.e., until the spring contact 21 lifts off from the contact 22, which can be detected and/or controlled without any problems with an electrical contact test or an electrical measuring circuit connected to the connectors 18 and 23. As soon as the switching system 4 opens, the current position of the adjusting plunger 25 is saved. The adjusting plunger 25 is moved back and it is checked whether the switching system 4 continues to remain open. Since there is always an elastic component involved when reforming the curvature of the curved region 24.3, moving the adjusting plunger 25 backwards normally results in closing the switching system 4 again. In a further adjusting step or when advancing the adjusting plunger 25 again, the position of the adjusting plunger 25 reached and saved during the preceding adjusting step is exceeded by a small stroke or amount (offset). Thereafter, saving of the current position of the adjusting plunger 25 and monitoring whether the switching system 4 remains open after the back movement of the adjusting plunger 25 is carried out again.

If necessary, this method can be repeated several times until the switching system 4 remains open and thus a sufficient, non-elastic or permanent deformation of the adjustment element 24 is achieved. So, the switching system 4 would open at a temperature that corresponds to that temperature that is detected by the temperature sensor 2 during the adjustment. If this is, for example, the normal ambient temperature and opening the switching system 4 is already desired at a switching point above the normal ambient temperature, for example at the switching point between 50° C. and 80° C., the adjustment then is carried out in such a manner that the adjustment element 24 is deformed in a first step only to such an extent that first, the switching system 4 actually opens, but closes again after the adjusting plunger 25 is moved back. Proceeding from the saved position of the adjusting plunger 25 at the end of the first adjusting step, another movement of the adjusting plunger 25 by a small stroke or amount (offset) takes place again. The latter is set in such a manner that this movement is not enough to keep the switching system 4 open after the adjusting plunger 25 is moved back, but that it moves the end 16.2 only to such an extent that the desired switching point above the ambient temperature is reached.

Furthermore, when adjusting the switching system 4, there is also the possibility to provide a spacer, e.g. in the form of an adjusting platelet 26 between the actuating element 8 and the switching spring 19, wherein the thickness of this platelet then corresponds to the temperature difference (temperature offset) between the transition temperature during the adjustment and the temperature of the desired switching point. Adjusting is carried out in at least one, but preferably in at least two steps in such a manner that the switching system 4 remains open after adjusting and retracting the adjusting plunger 25. Then, the spacer is removed. For setting the temperature offset as precisely as possible, the ambient temperature can also be taken into account during the adjustment and can be compensated accordingly.

Figure 3:
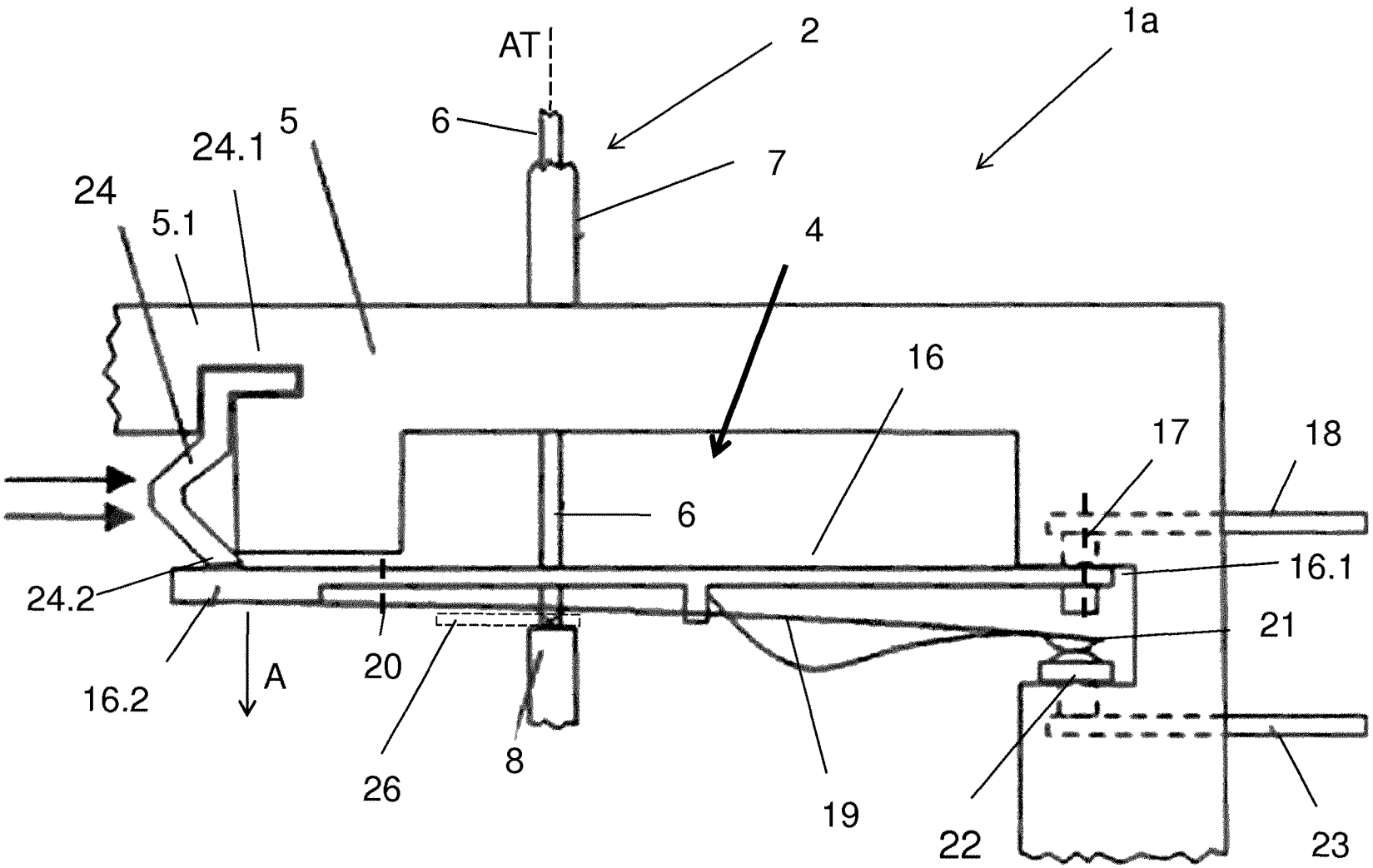
FIG. 3 shows in an enlarged partial illustration a further embodiment of the temperature controller according to the invention.

FIG. 3 shows as a further embodiment in a partial illustration a temperature controller la which differs from the temperature controller 1 substantially only in that the adjustment element 24, which rests with its lower end 14.2 against the upper side of the switching spring base 16, is not oriented at an angle, but perpendicular or substantially perpendicular with respect to the switching spring base 16.

REFERENCE LIST

1, 1*a* temperature controller
2 temperature sensor
3, 4 switching system
5 temperature controller housing
6 rod-shaped expansion element
7 tube section
8 actuating element
8.1 spring
9 switching spring base
10 fastening point of switching spring base
11 connector
12 switching spring
13 spring contact
14 contact
15 connector
16 switching spring base
16.1, 16.2 end of switching spring base 16
17 fastening point
18 connector
19 switching spring
20 fastening of switching spring 19 on the switching spring base 16
21 spring contact
22 contact
23 connector
24, 26 adjustment element
24.1, 24.2 end of adjustment element
24.3 curved region of the adjustment element
24.3.1, 24.3.2, 24.3.3 leg
25 adjusting plunger
A longitudinal direction of the adjustment element
J adjusting direction
AT axis of the temperature sensor 2

The invention claimed is:

1. A temperature controller comprising:

a temperature controller housing (5), a temperature sensor (2) with an expansion element (6) which generates a movement stroke in a direction of action (AT) as a function of temperature, a first switching system (4) having a first switching spring (19) at a first switching spring base (16) on which the expansion element (6) or an actuating element (8) moved by said expansion element acts in order to switch the first switching system (4), wherein the first switching spring base (16) has a first end (16.2) of the switching spring base (16) on a first side of the expansion element (6) or the actuating element (8) and a second end (16.1) on a second side of the expansion element (6) or an actuating element (8) and a spring contact (21) disposed on the first switching spring (19) and the first switching spring base (16) is fastened to the first switching spring (19) at a point of attachment, wherein the first switching spring base (16), at the second end (16.1) is disposed on the temperature controller housing (5) and the first switching spring base (16) interacts with an adjustment element (24), one end (24.1) of said adjustment element disposed on a region (5.1) of the temperature controller housing (5) and a second end (24.2) of said adjustment element disposed against the first switching spring base (16), and by means of which, in order to adjust a switching point of the first switching system (4), the first switching spring base (16) together with the first switching spring (19) can be moved relative to the expansion element (6) and/or to the actuating element (8) upon change of a distance between the region (5.1) of the temperature controller housing (5) and the first switching spring base (16), characterized in that the adjustment element (24) is an elongate element having a longitudinal direction (A), wherein the adjustment element (24), for adjusting in an adjustment direction (J), can be permanently deformed transverse to its longitudinal direction (A) upon change of the distance between the first end (24.1) and the second end (24.2).

2. The temperature controller according to claim 1, further comprising:

a second switching system (3) controlled by the temperature sensor (2), said second switching system comprising a second switching spring (12) and a second switching base (9).

3. The temperature controller according to claim 1, characterized in that the adjustment element (24) rests with the second end (24.2) of said adjustment element (24) against a side of the first switching spring base (16), said side facing away from the first switching spring (19).

4. The temperature controller according to claim 1, characterized in that the adjustment element (24) is composed of a metallic material.

5. The temperature controller according to claim 1, characterized in that the adjustment element (24) is provided, between the first end (24.1) and a second end (24.1) of said adjustment element, a curved region (24.3) that can be deformed to change a distance between the first end (24.1) and the second end (24.2).

6. The temperature controller according to claim 5, characterized in that the curved region (24.3) can be deformed upon increasing the distance between the first end (24.1) and the second end (24.2).

7. The temperature controller according to claim 6, characterized in that the curved region (24.3) has a U or V shape.

8. The temperature controller according to claim 2, characterized in that the first switching system (4) and the second switching system (3) are arranged successively in the direction of action of the expansion element (6) in the temperature controller housing (5).

9. The temperature controller according to claim 1, characterized in that the first switching spring base (16) is provided with a predetermined bending point in the form of a tapering, wherein the tapering is provided in a region of the first switching spring base (16), which region is adjacent to the end (16.1) of the first switching spring, at which end the first switching spring base (16) is secured on the temperature controller housing (5).

10. A method for adjusting the temperature controller of claim 1, comprising the steps of:

a) providing the temperature controller (1, la) according to claim 1, b) fixing said temperature controller (1, la) according to claim 1 in an adjusting device, c) moving an adjusting plunger (25) towards the adjustment element (24), d) performing a first electrical contact test using connectors (18, 23) of the first switching system (4) of the temperature controller (1, 1*a*), e) saving the position of the adjusting plunger (25) as soon as the electrical contact test indicates a negative signal, f) moving the adjusting plunger (25) in a direction away from the adjustment element (24), g) performing a second electrical contact test using the connectors (18, 23) of the first switching system (4) of the temperature controller (1, 1*a*).

11. The method according to claim 10, characterized in that after step g), the following steps are carried out:

h) moving the adjusting plunger (25) towards the adjustment element (24) if the electrical contact test performed in step g) indicates a positive signal, i) performing a third electrical contact test using the connectors (18, 23) of the first switching system (4), j) saving the position of the adjusting plunger (25) as soon as the third electrical contact test performed in step i) indicates a negative signal, k) moving the adjusting plunger (25) in a direction away from the adjustment element (24), l) performing a fourth electrical contact test using the connectors (18, 23) of the switching system (4).

12. The method according to claim 11, characterized in that after step l), the steps h) to l) are repeated several times until the electrical contact test performed in step l) indicates a negative signal.

13. The method according to claim 12, characterized in that prior to step c), an adjusting platelet (26) is arranged between the actuating element (8) and the first switching spring (19).

14. The method according to claim 13, characterized in that the adjusting platelet (26) arranged between the actuating element (8) and the first switching spring (19) is removed when one of the second or fourth of the electrical contact tests using the connectors (18, 23) of the first switching system (4) indicates a negative signal.

15. The method according to claim 11, characterized in that prior to step c), an adjusting platelet (26) is arranged between the actuating element (8) and the first switching spring (19).

16. The method according to claim 15, characterized in that the adjusting platelet (26) arranged between the actuating element (8) and the first switching spring (19) is removed when any one of the electrical contact tests performed immediately after any step of moving the adjusting plunger (25) in a direction away from the adjustment element (24) and before a subsequent step of moving the adjusting plunger (25) towards the adjustment element (24), indicates a negative signal.

17. The method according to claim 12, characterized in that the adjusting platelet (26) arranged between the actuating element (8) and the first switching spring (19) is removed when any one of the electrical contact tests performed immediately after any step of moving the adjusting plunger (25) in a direction away from the adjustment element (24) and before a subsequent step of moving the adjusting plunger (25) towards the adjustment element (24), indicates a negative signal.

* * * * *